US006578918B1

(12) United States Patent
Rinne et al.

(10) Patent No.: US 6,578,918 B1
(45) Date of Patent: Jun. 17, 2003

(54) CHAIR

(76) Inventors: Tommi Rinne, Järnåldersringen 847, Haninge (SE), 136 65; Kari Rinne, Järnåldersringen 623, Haninge (SE), 136 65; Yrjö Rinne, Skyttens gata 549, Haninge (SE), 136 61

( * ) Notice: Subject to any disclaimer, the term of this patent is extended or adjusted under 35 U.S.C. 154(b) by 0 days.

(21) Appl. No.: 09/622,900

(22) PCT Filed: Feb. 25, 1999

(86) PCT No.: PCT/SE99/00265

§ 371 (c)(1),
(2), (4) Date: Nov. 20, 2000

(87) PCT Pub. No.: WO99/44475

PCT Pub. Date: Sep. 10, 1999

(30) Foreign Application Priority Data

Mar. 3, 1998 (SE) ..... 9800654

(51) Int. Cl.[7] ..... A47C 1/02
(52) U.S. Cl. ..... 297/320; 297/312
(58) Field of Search ..... 297/320, 311, 297/321, 313, 314, 300.1, 300.4, 312, 344.19, 337

(56) References Cited

U.S. PATENT DOCUMENTS

| | | | | |
|---|---|---|---|---|
| 4,334,709 A | | 6/1982 | Akiyama et al. | 297/284 |
| 4,521,053 A | * | 6/1985 | De Boer | 297/313 X |
| 4,765,679 A | * | 8/1988 | Lanuzzi et al. | 297/312 X |
| 4,792,185 A | * | 12/1988 | Oshikawa | 297/337 X |
| 5,114,211 A | * | 5/1992 | Desanta | 297/300.4 |
| 5,167,435 A | * | 12/1992 | Aldi | 297/312 X |
| 5,401,077 A | * | 3/1995 | Hosoe | 297/312 |
| 5,536,067 A | * | 7/1996 | Pinto | 297/312 X |
| 5,904,397 A | * | 5/1999 | Fismen | 297/313 X |

FOREIGN PATENT DOCUMENTS

| | | |
|---|---|---|
| WO | 96/11614 | 4/1996 |
| WO | 97/10735 | 3/1997 |

* cited by examiner

*Primary Examiner*—Peter M. Cuomo
*Assistant Examiner*—Stephen Vu
(74) *Attorney, Agent, or Firm*—Jacobson Holman PLLC

(57) ABSTRACT

A chair includes a seat (4) and a backrest (5). The seat (4) includes a front seat part (41) which is carried by a chair base structure (1, 2, 7, 71), and a rear seat part (42) which borders on the front seat part (41) along a join line that extends generally perpendicular to a symmetry plane of the chair (3). The chair includes a member (7) for selectively adjusting the distance between the seat join line (43) and the backrest (5) so as to enable a chair user sitting on the seat (4) with his back in contact with the backrest (5) to take a sitting position in which his hip joints lie generally in a vertical plane that includes the join line (43). Moving members (8, 9, 14, 15, 16) are provided for moving the rear seat part (42) vertically relative to the front seat part (41). The moving member includes a lever (9) and a support point (15) which is stationary relative to the front seat part (41). The blocking device (14) has a variable length and, in one end position, functions to cause the lever (9) to hold the rear seat part (42) flush with the front seat part (41). The chair also includes a triggering device (16) which upon manual activation functions to reduce the length of the blocking device (14) and thereby lower the rear seat part (42) relative to the front seat part.

10 Claims, 2 Drawing Sheets

CHAIR

BACKGROUND OF THE INVENTION

Field of the Invention

The present invention generally relates to a chair that includes a seat and a backrest, wherein the seat includes a front part which is carried by a seat base structure, and a rear seat part which borders on the front seat part along a join line which extends generally perpendicularly to a chair symmetry plane, wherein the chair includes means for selectively setting or adjusting the distance between the seat join line and the backrest so that a chair user sitting on the seat with his back in contact with the backrest can take a sitting position in which his hip joints lie generally in a vertical plane that includes the join line, and wherein means are provided for moving the rear seat part vertically in relation to the front seat part.

A chair of this kind is known from an International Application Number WO 97/10735 published under the Patent Cooperation Treaty.

SUMMARY OF THE INVENTION

The invention thus relates to a chair of the kind which includes a seat and a backrest, wherein the seat includes a front part which is supported by a chair base, and a rear part which borders on the front part of the seat along a join line which extends generally parallel with the intersection between the seat and the backrest, wherein means are provided for selectively adjusting the horizontal distance between the seat join line and the backrest, and wherein means are provided for moving the rear seat part vertically relative to the front seat part.

The user of such a chair adjusts the distance between the backrest and the join line so that a vertical plane through the hip joints of the user will coincide generally with the join line, when the user rests his back against the backrest with his upper body generally straight and with his buttocks seated on the chair seat.

Assuming that the upper surfaces of the rear and the front seat parts lie generally in one and the same plane, i.e. are essentially flush with one another, most of the user's weight will be supported by the rear part of the seat.

When the rear part of the seat is lowered, a large part of the earlier load on the rear part of the seat (or the whole of the load) is likely to be transferred to the front part of the seat. Because the join line is set so as to coincide with the vertical plane through the wearer's hip joints (or immediately beneath the ischial tuberosities), the increase in weight will not result in any upward rotary force against the user's thighs. The friction between the backrest of the chair and the user's spine will take-up part of the user's weight.

That part of the user's buttocks supported by the rear part of the seat is now able to sag and therewith subject the lumbar region of the wearer's back to traction.

By restricting vertical downward movement of the rear part of the seat, the user is able to adjust the seat for desired traction of the lumbar region and/or to adjust the chair for desired transfer of load form the rear part of the seat to its front part.

The object of the present invention is to provide a simple construction which can be readily manufactured and easily fitted and which can be easily maneuvered by the mechanism that supports the rear part of the chair seat. Another object is to provide a construction which can be readily fitted to a typical chair base, for instance of the kind which enables the chair to be tilted, raised, twisted or moved in some other way relative to the chair support base.

These objects are achieved with a chair that includes a seat and a backrest. The seat includes a front part carried by a seat base structure, and a rear seat part which borders on the front seat part along a join line. The join line extends generally perpendicularly to a chair symmetry plane. The chair includes means for selectively setting or adjusting the distance between the seat join line and the backrest so that a chair user sitting on the seat with his back in contact with the backrest can take a sitting position in which his hip joints lie generally in a vertical pane that includes the join line. Means are provided for moving the rear seat part vertically in relation to the front seat part. The vertical movement means include a lever which is pivotally mounted on the front seat part and which supports the rear seat part for vertical movement.

Also, there is a blocking device which is adapted to operate between the lever and a support point which is stationary relative to the front seat part. The blocking device (14) has a variable length and in one terminal position functions to cause the lever to hold the rear seat part flush with the front seat part. A trigger mechanism, when actuated manually, causes the length of the blocking device to be reduced and therewith lower the rear seat part in relation to the front seat part.

Further embodiments of the inventive chair are that the lever is a bell-crank lever, and the blocking device is orientated to establish a length variation generally in a horizontal direction parallel with the chair symmetry plane.

Additionally, the blocking device is a gas spring that includes a latching device and a mechanical spring which acts in a direction in which it strives to return the rear seat part to the same level as that occupied by the front seat part.

The gas spring comprises a cylinder that includes a piston having a valve means. The piston is connected to a piston rod. The lever is a bell-crank lever which includes an arm that extends downwardly from the pivot point. The cylinder of the gas spring is pivotally mounted on a pivot point at the free end of the lever arm, and the piston rod of the gas spring is fixedly connected to the support point. The latching means includes a rod that extends coaxially through the piston rod and projects out from the free end of the piston rod. A trigger mechanism is pivotally mounted on the front seat part to permit the rear seat part to be lowered when activated.

In preferred embodiments of the invention, the longitudinal axis of the blocking device extends generally parallel with the longitudinal axis of the chair. The blocking device may consist of a gas spring which is spring-biased so as to return the rear part of the seat to its terminal position in which it lies flush with the front part of the seat, in the absence of load on the rear part of the seat and upon activation of the trigger mechanism. The gas spring will conveniently include a valve means which can be activated by the trigger mechanism and which separates the primary gas-pressure applying chamber of the gas spring from the secondary gas chamber thereof. The through-passage of the open valve may be adapted to restrict the speed at which the piston rod/piston of the gas spring moves in relation to the cylinder part of the spring.

By suspending the rear part of the seat from a so-called bell-crank lever which is pivotally mounted on the front part of the seat, the means for moving the rear part of the seat vertically can be given a small structural height and can be supported by the front part of the seat.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE DRAWINGS

The invention will now be described with reference to an exemplifying embodiment thereof and also with reference to the accompanying drawings, in which.

DESCRIPTION OF THE INVENTION

Figure 1:
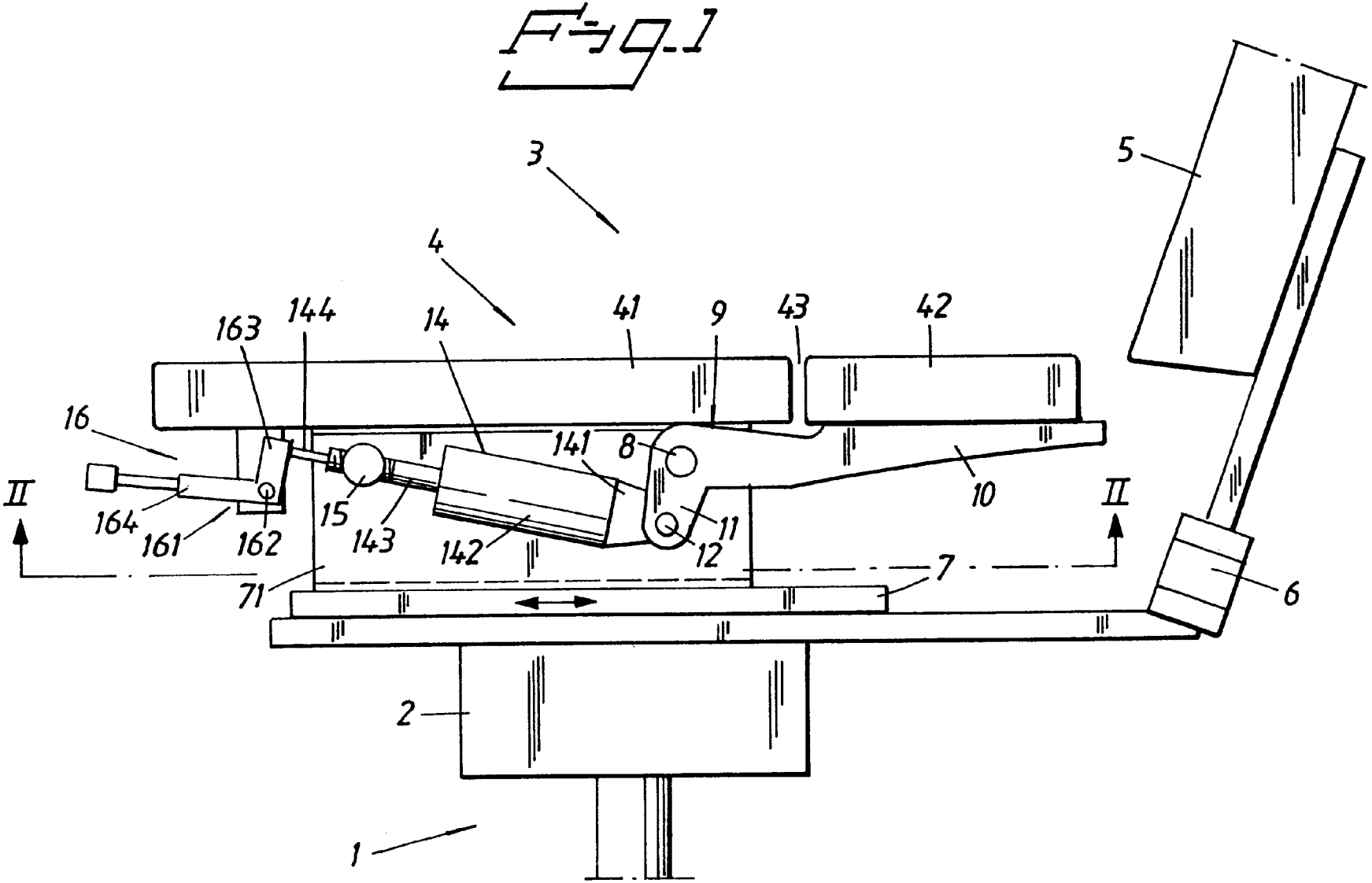
FIG. 1 is a schematic side view of a chair constructed in accordance with the invention.
Figure 2:
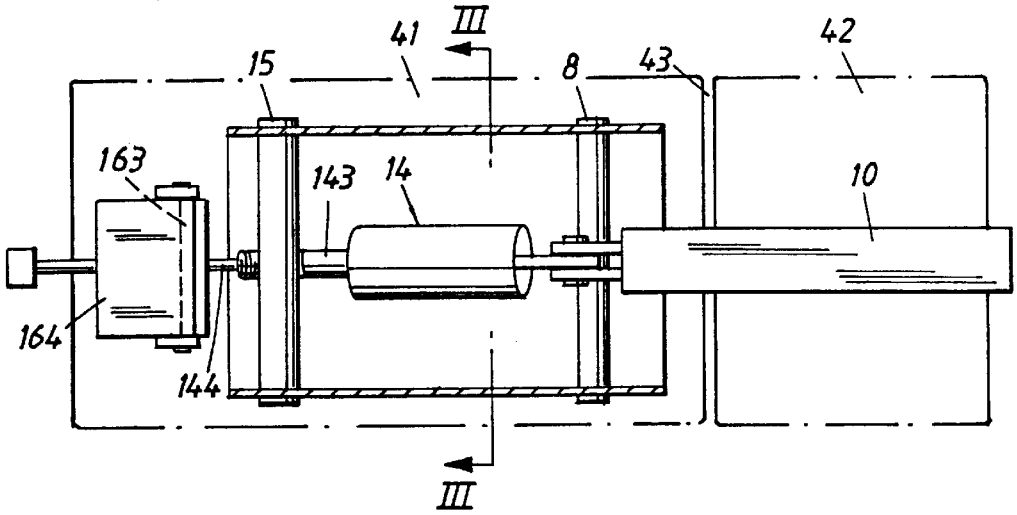
FIG. 2 is a view taken on the line II—II in FIG. 1.
Figure 3:
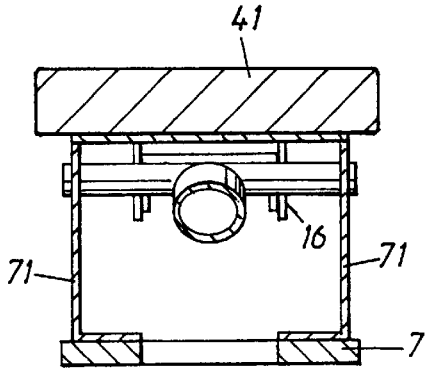
FIG. 3 is a schematic sectional view taken on the line III—III in FIG. 2.
Figure 4:
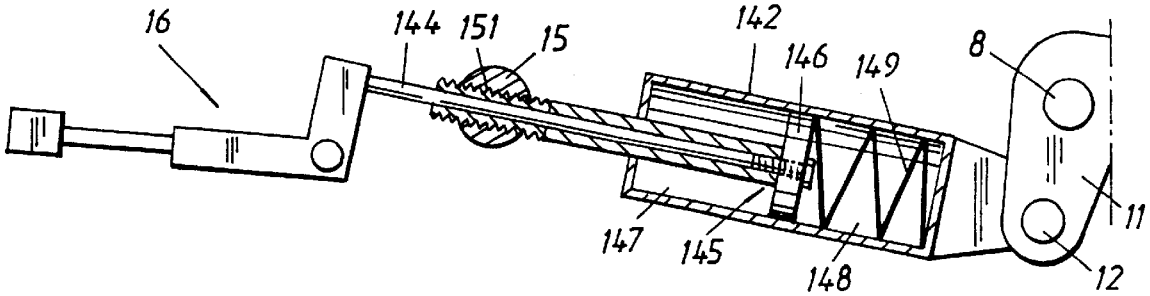
FIG. 4 is a schematic, partially sectioned view of the arrangement shown in FIG. 1.

Although only one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Shown in FIG. 1 is a chair base structure 1 that includes conventional means 2 for raising/lowering, tilting, twisting or rotating a chair seat 4 that forms part of a chair 3 constructed in accordance with the invention. The chair also includes a backrest 5, which is supported by the base structure 1. The backrest 5 is also supported by a device 6 which enables the backrest to be raised/lowered, tilted, twisted or moved.

The illustrated chair seat 4 is carried by a slide 7 which can be moved horizontally towards and away from the backrest 5, which can therewith be held in a fixed position relative to the base structure 1. The slide 7 can be locked in a desired position with the aid of means not shown.

The chair seat 4 includes a front part 41 and a rear part 42. A join line 43, between the seat parts 41, 42, is generally parallel with the intersection line between the seat 4 and the backrest 5. The join line 43 shall have the extension described in more detail in WO 97/10735, the teachings of which are that the join line 43 between the seat parts 41, 42 will remain essentially closed during parallel movement of the rear seat part 42. The parts 41, 42 are supported from the base plate 71 which in turn can be displaced in the longitudinal direction of the chair in relation to the base 2. This enables changes to be made to the distance between the backrest 5 and the position of the front seat part 41. The distance can be set so that the user's hip joints will lie generally in a vertical plane through the join line 43 when the user's back is in contact with the backrest 5.

The slide supports the front part 41 of the seat with the aid of two mutually spaced and mutually parallel plate profiles 71.

A horizontal pivot shaft 8 is carried between the profiles 71. The pivot shaft 8 supports the knee or fulcrum point of a bell-crank lever 9, the arms 10, 11 of which lie in a vertical plane which includes the longitudinal axis of the chair and which preferably constitutes a chair symmetry plane. The longer arm 10 of the lever 9 extends rearwardly from the front part 41 of the chair and carries the rear part 42 of said chair. The arm 10 is suitably designed so as to strike against the undersurface of the front seat-part 41 in an outwardly swung position, wherewith the top surfaces of the two seat-parts 41, 42 lie essentially in a common plane, at least in the region of the join 43.

Extending between the front parts of the profiles 71 is a horizontal rotatable shaft 15 that has a transversal threaded opening 151 which receives a threaded end-part of a piston rod 143 projecting forwardly from a cylinder body 142 belonging to a gas spring 14, a rear end-part 141 of which is pivotally mounted on a pivot point 12 on the shorter arm 11 of the bell-crank lever 9, at a distance beneath the pivot mounting 8 of the arm.

The gas spring 14 is of conventional design and includes a trigger mechanism rod 144 which extends centrally and coaxially through the piston rod 143 and projects out from the front end of said rod. The trigger mechanism rod 144 operates a valve 145. The spring includes a piston or plunger 146 which divides the cylinder 142 into two chambers 147, 148. In the illustrated case, the chamber 148 contains a mechanical spring 149 which biases the gas spring 14 towards its maximum length.

Located at the bottom edge of the front edge of the front seat part 41 is a trigger mechanism 16 which includes a bell-crank lever 161 which is pivotally mounted at its knee or fulcrum point on a stationary shaft 162 that extends parallel with the aforesaid shafts 8 and 15. In the non-activated state of the trigger mechanism 16, a generally upwardly extending arm 163 is located immediately in front of the end of the rod 144 and positioned above the pivot shaft 162. The other arm 164 of the bell-crank lever extends forwardly and can be raised by the user, therewith causing the bell-crank lever 9 to be swung clockwise in FIG. 1 under the influence of a load on the rear part 42 of the seat, so as to lower the rear seat part 42 in relation to the front seat part 41. As soon as the trigger mechanism 16 is released, the valve 145 is closed so that load acting vertically downwards on the rear seat part 42 will be captured by the gas spring 14 while compressing gas enclosed in the chamber 148. The shaft 15 is mounted for rotation about its axis.

The invention can be modified in several respects.

For instance, the gas spring 14 can be replaced with a setting device or adjuster that is driven by an electric motor and operates between the shafts 8 and 15. In this regard, a trigger mechanism in the form of an electric switch can be placed at any desired position to enable selective raising/lowering of the rear part 42 of the seat relative to the front part 41 thereof Another alternative is to provide a trigger mechanism in the form of, e.g., a purely mechanical blocking device coupled to operate between the points 12 and 15 with the aid of an operating lever that can be swung forwardly/rearwardly by the user to set the relative height position of the rear part 42 of the seat. The blocking device will preferably be self-latching, i.e. adapted to latch at least in the compression direction, when the trigger mechanism is released.

In another embodiment of the invention, the blocking device may act directly between the slide 7 and the arm 10 of the lever.

The plate profiles 71 form spacing elements and define a vertical space in which the arrangement for raising/lowering the rear seat part 42 can be placed. The profiles 71 can be mounted directly on a conventional seat base 1, 2, at least in the case of office chairs and the like.

It will be understood, however, that the base structure 1, 2 and also the backrest device 6 can be given some other design in the case of chairs intended for ships, boats and motor vehicles.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A chair having a seat and a backrest, the seat includes a front seat part carried by a seat base structure, and a rear seat part which borders on the front seat part along a join line which extends generally perpendicularly to a chair symmetry plane, the chair includes means for selectively adjusting a distance between the seat join line and the backrest so that a chair user sitting on the seat with his back in contact with the backrest can take a sitting position in which his hip joints lie generally in a vertical plane that includes the join line, and vertical movement means for moving the rear seat part vertically in relation to the front seat part, wherein the improvement comprising:

said vertical movement means including a lever pivotally mounted on the front seat part for supporting the rear seat part for vertical movement independently of the backrest;

a blocking device adapted to operate between the lever and a support point which is stationary relative to the front seat part, the blocking device having a variable length and in one terminal position functions to cause the lever to hold the rear seat part flush with the front seat part;

a trigger mechanism which when actuated manually causes the length of the blocking device to be reduced and thereby lower the rear seat part in relation to the front seat part;

said blocking device being a gas spring having a latching device and a mechanical spring acting in a direction to return the rear seat part to a same level as that occupied by the front seat part; and the gas spring includes a cylinder that includes a piston having a valve, said piston being connected to a piston rod, and said lever being a bell-crank lever which includes a lever arm extending downwardly from a pivot point of said vertical movement means, the cylinder of the gas spring is pivotally mounted on a pivot point at a free end of the lever arm, and the piston rod of the gas spring is fixedly connected to the support point;

said latching device includes a rod extending coaxially through the piston rod and projects out from a free end of said piston rod; and said trigger mechanism being pivotally mounted on the front seat part to permit the rear seat part to be lowered when activated.

2. The chair according to claim 1, wherein the blocking device is orientated to establish a length variation generally in a horizontal direction parallel with the chair symmetry plane.

3. A chair seat comprising:

a base structure;

a front seat part moveably mounted to said base structure;

a backrest moveably mounted to said base structure;

a rear seat part positioned behind said front seat part and moveably mounted to said base structure;

an adjusting member attached to said base structure for selectively adjusting a distance between said front seat part and said backrest;

a lever pivotally mounted on said front seat part for supporting independent vertical movement of said rear seat part;

a blocking device adapted to operate between said lever and a supporting point which is stationary relative to said front seat part, said blocking device is a gas spring having a latching device and a mechanical spring for acting in a direction to return the rear seat part to a same level as that occupied by the front seat part;

said gas spring includes a cylinder with a piston having a valve, said piston connected to a piston rod, and said lever is a bell-crank lever which includes a lever arm extending downwardly from a pivot point of a vertical movement member, and said cylinder is pivotally mounted on a pivot point at a free end of said lever arm; and said piston rod is fixedly connected to a support point, said latching device includes a rod extending coaxially through said piston rod and projects out from a free end of said piston rod, and a trigger mechanism being pivotally mounted on said front seat part to permit said rear seat part to be lowered when activated.

4. The chair seat according to claim 3, wherein said blocking device has a variable length and in one terminal position functions to cause said lever to hold said rear seat part flush with said front seat part; and said trigger mechanism extending from said blocking device, and when manually actuated, causes said blocking device to be reduced in length and thereby lowering said rear seat part in relation to said front seat part.

5. The chair seat according to claim 3, wherein said blocking device is orientated to establish a length variation generally in a horizontal direction parallel with a chair symmetry plane.

6. A chair comprising a base structure and a seat connected to said base structure, said seat having a moveable front seat part and a moveable rear seat part positioned behind said front seat part, a backrest moveably mounted to said base structure and positioned a distance from said front seat part and adjacent to said rear seat part, an adjusting member attached to said base structure for selectively adjusting said distance between said front seat part and said backrest, and a vertical movement member attached to said base structure for moving said rear seat part vertically in relation to said front seat part independently of said backrest;

said vertical movement member includes a blocking device adapted to operate between a lever and a supporting point which is stationary relative to said front seat part;

said blocking device has a variable length and in one terminal position functions to cause said lever to hold said rear seat part flush with said front seat part; and a trigger mechanism extending from said blocking device, and when manually actuated, causes said blocking device to be reduced in length and thereby lowering said rear seat part in relation to said front seat part.

7. The chair according to claim 6, wherein said vertical movement member comprises a lever pivotally mounted on said front seat part for supporting said independent vertical movement of said rear seat part.

8. The chair according to claim 6, wherein said lever is a bell-crank lever.

9. The chair according to claim 6, wherein said blocking device is orientated to establish a length variation generally in a horizontal direction parallel with a chair symmetry plane.

10. A chair comprising a base structure and a seat connected to said base structure, said seat having a moveable front seat part and a moveable rear seat part positioned behind said front seat part, a backrest moveably mounted to said base structure and positioned a distance from said front seat part and adjacent to said rear seat part, an adjusting member attached to said base structure for selectively adjusting said distance between said front seat part and said backrest, and a vertical movement member attached to said base structure for moving said rear seat part vertically in relation to said front seat part independently of said backrest;

said vertical movement member includes a blocking device adapted to operate between a lever and a supporting point which is stationary relative to said front seat part; and said blocking device being a gas spring having a latching device and a mechanical spring for acting in a direction in which to return said rear seat part to the same level as that occupied by said first seat part.

* * * * *